United States Patent [19]

Forsberg et al.

[11] Patent Number: 4,490,247

[45] Date of Patent: Dec. 25, 1984

[54] AIR STREAM SEPARATOR

[76] Inventors: Lennart G. K. Forsberg, Carl Gustafs väg 19, S-217 42 Malmö; Per-Ingvar Moberg, Solvägen 4G, 873 00 Bollstabruk, both of Sweden

[21] Appl. No.: 414,350

[22] PCT Filed: Jan. 28, 1982

[86] PCT No.: PCT/SE82/00023

§ 371 Date: Aug. 12, 1982

§ 102(e) Date: Aug. 12, 1982

[87] PCT Pub. No.: WO82/02503

PCT Pub. Date: Aug. 5, 1982

[30] Foreign Application Priority Data

Jan. 29, 1981 [SE] Sweden ..... 8100637

[51] Int. Cl.[3] ..... B07B 7/00

[52] U.S. Cl. ..... 209/20; 209/135; 209/137; 209/143

[58] Field of Search ..... 209/20, 134, 135, 136, 209/137, 143

[56] References Cited

U.S. PATENT DOCUMENTS

| | | | |
|---|---|---|---|
| 1,648,716 | 11/1927 | Berrisford | 209/137 |
| 1,962,668 | 6/1934 | Olney | 209/136 |
| 3,334,739 | 8/1967 | Jarvis | 209/136 |
| 3,485,361 | 12/1969 | Adams | 209/137 |
| 4,089,422 | 5/1978 | Harmke et al. | 209/137 |
| 4,191,294 | 3/1980 | McGrath, Jr. et al. | 209/135 |
| 4,219,410 | 8/1980 | Herder | 209/136 |

FOREIGN PATENT DOCUMENTS

| | | | |
|---|---|---|---|
| 257284 | 2/1927 | United Kingdom | 209/134 |
| 865432 | 9/1981 | U.S.S.R. | 209/137 |

*Primary Examiner*—David L. Lacey

*Attorney, Agent, or Firm*—Silverman, Cass & Singer, Ltd.

[57] ABSTRACT

An air stream separator for separating heavier and lighter fractions from a mixture, includes a first vibrating conveyor which conveys the mixture of materials into an upwardly directed air stream at the output end of the conveyor, and a second vibrating conveyor positioned at or below the level of the first conveyor; the second vibrating conveyor includes an input end defined by an upwardly inclined portion onto which a heavier fraction of mixture drops from the output of the first conveyor so that the heavier fraction is separated from the lighter fraction which is impelled by the air stream onto a main, horizontal portion of the second conveyor for conveyance thereon.

13 Claims, 7 Drawing Figures

AIR STREAM SEPARATOR

BACKGROUND OF THE INVENTION

This invention relates to separating apparatus, and more particularly to an air stream separator, for example for separating chips or biomass from heavier material.

In air stream separation, the material to be separated is introduced in mixed condition into an air stream, whereby the material is divided into fractions, of which the lightest material follows along furthest in the air stream direction. In the initial phase of separation, i.e. when the material is being introduced into the separating air stream, the material behaves in unsorted manner, and after having been passed through a certain distance, a heavier fraction, for example, has been separated from other fractions. The distance, through which the material is unsorted, can be relatively long. This is a disadvantage, because the air stream separating installation must be designed with greater dimensions.

When the starting material, from which, for example, stones and metal particles are to be separated, consists of a lot of particles having about the same size and density, heavy particles can be separated by air stream separation and by using known art, without affecting the particle distribution of the material.

When, however, the light phase consists of a mixture of particles having varying density and/or size, air stream separation carried out according to known art results in the light phase being separated in such a manner that particles with similar properties are gathered together. A starting material in which particles with different properties are well mixed, thereby is converted into a material partially classified with respect to size and/or density. In many industrial processes it is desirable that the material be well mixed. Air stream separation according to known art, therefore, produces the disadvantage, that chips, from which, for example, stones have been removed after the separation are divided into fractions of similar fragment size.

It is also desirable to separate stones and other heavy impurities from biomass, which itself includes heavy fractions, such as stump parts, branch parts etc.

SUMMARY OF THE INVENTION

The present invention solves the aforesaid problems and offers an apparatus, which according to one embodiment provides a well-mixed air stream separated material, and according to one embodiment also achieves air stream separation of biomass.

The present invention relates to an air stream separator for separating a heavy fraction, for example stones, from a mixture of light particles with different properties, for example chips, comprising a conveyor and a fan or the like, of which latter an air nozzle located at the output end of the conveyor provides an air stream directed upward and forward in the conveying direction of the conveyor. The conveyor a so-called vibrating conveyor, in which the heavy fraction collects on the conveyor bottom. An additional vibrating conveyor is located in the conveying direction after the output end of the first conveyor and on the same or a lower level. The second conveyor includes an upwardly inclined portion at its input end which leads into a portion in parallel with the main conveying direction of the first conveyor. The inclined portion is located in relation to the output end of the first conveyor, to enable heavy fractions to drop down on the inclined portion and be conveyed downward.

BRIEF DESCRIPTION OF THE DRAWING

The invention is described in greater detail in the following, with reference to the accompanying drawings, in which.

One objective of the invention, bringing about a well-mixed air separated product, is achieved according to one embodiment, by advancing the material, from which the heavier particles are to be separated, on, for example, three vibrating conveyors or so-called rocking chutes, located one above the other into three individual air streams, which are directed upward in the conveying direction. When the material, consisting of chips and a heavy fraction, for example, stones or metal parts to be separated from the chips, is supplied to the separating air stream on a rocking chute, the heavy fraction is obtained at the bottom of the load stand. A substantially immediate separation of the heavy fraction is obtained when the rocking chute terminates with an air nozzle which is directed slightly upward in the conveying direction and ejects an air steam. The air steam lifts the chips in an outgoing direction, which closely coincides with the air steam direction. At the end of the rocking chute the heavy fraction, consisting, for example, of stones lying on the bottom of the rocking chute, drops down past the nozzle into an inclined plane and is thereby separated from the light fraction by being conveyed in a direction opposed to the conveying direction of the first rocking chutes. The light fraction then can be subjected to a turbulent air stream, which does not produce classification of particles.

DETAILED DESCRIPTION OF THE PREFERRED EMBODIMENTS

Figure 1:
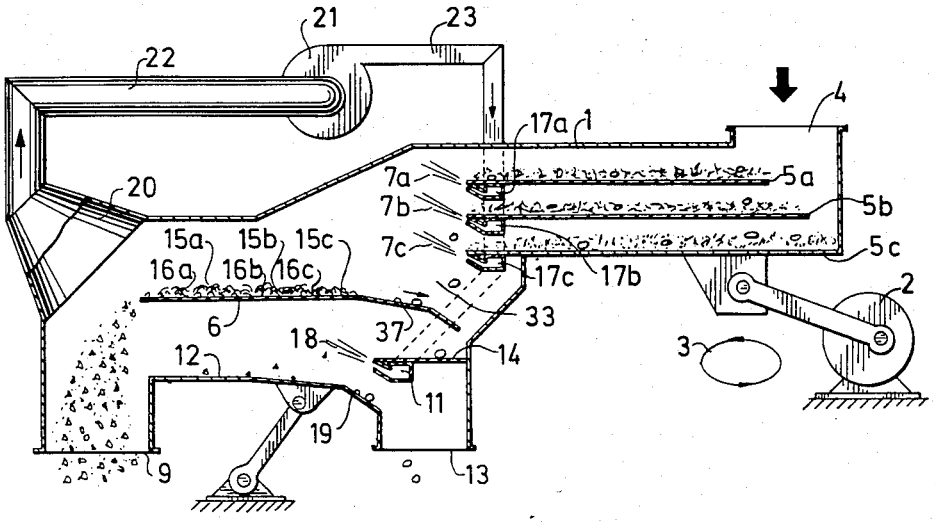
FIG. 1 is a longitudinal section of an air stream separator according to a first embodiment of the invention.
Figure 2:
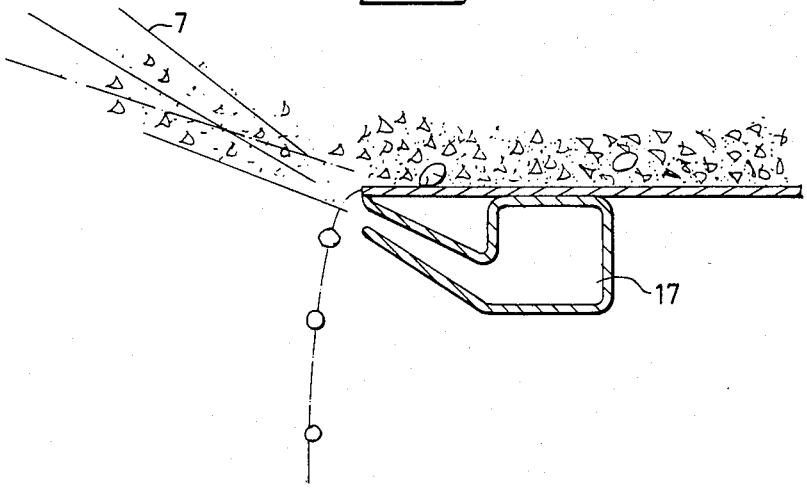
FIG. 2 shows a portion of FIG. 1, into which particle paths have been plotted.

The air steam separator shown by way of example in FIG. 1 can be intended, for example, for the separation of stones and similar heavy particles from chips, before the chips are subjected to digesting or other processing in a pulp industry. The separator according to a first embodiment comprises a number of rocking chutes 5*a*, 5*b* and 5*c*, respectively, mounted in a housing 1. Said housing is set in motion by a vibration device 2 which causes the housing and chutes to move according to the arrows 3 whereby the chutes vibrate up and down through planes parallel to the longitudinal direction thereof. The chips are fed downward through an inlet opening 4 and drop down into the three rocking chutes 5*a*, 5*b*, and 5*c*, respectively, which distribute the chips in such a manner, that on each of the rocking chutes 5*a*, 5*b*, and 5*c*, respectively, a layer of just the right thickness is obtained. The chutes are mounted rigidly in the housing 1, and by their vibrating movements the chips advance forward until they arrive at three air nozzles 17*a*, 17*b*, and 17*c*, respectively, located one above the other. Out of these air nozzles 17*a*, 17*b*, and 17*c*, respectively, air is ejected upward in the conveying direction of the chips. The chips are moved from each of the rocking chutes 5*a*, 5*b*, amd 5*c*, respectively, causing the chips to move forward and upward in the main conveying direction, which movement describes a path resembling a parabola. The chips then come down on a lower additional rocking chute 6, which has a relatively strongly inclined portion 37 at the end located closest to its input end and substantially horizontal at the opposite end. The stones are collected at the bottom of the rocking chutes 5*a*, 5*b*, and 5*c*, respectively, and are not lifted by the air stream when arriving at the air nozzles 17*a*, 17*b*, and 17*c*, respectively. When the stones leave the rocking chutes 5*a*, 5*b*, and 5*c*, respectively, they immediately move in a downward direction and thereby are substantially separated from the chips. The stones descend on the inclined portion 37 of the rocking chute 6, which prevents the stones from advancing to an outlet opening 9, and instead imparts a horizontal component of rearward motion, so that the stones fall down into the plate 14.

The chips from the three rocking chutes 5*a*, 5*b*, and 5*c*, respectively, describe different parabolic paths and drop to different places on the lower rocking chute 6. The heavier chip particles from the rocking chutes 5*a*, 5*b*, and 5*c*, respectively, drop to 15*a*, 15*b*, and 15*c*, respectively. The lighter chip particles from the rocking chutes 5*a*, 5*b*, and 5*c*, respectively, come down in 16*a*, 16*b*, and 16*c*, respectively.

The different chip fractions from the rocking chutes 5*a*, 5*b*, and 5*c*, respectively, come down on the lower rocking chute 6 in such a manner, that they are intermixed. The mode of operation of the rocking chutes contributes to mixing the different chip fractions together, if a separation into such fractions should have occurred during the air transport between the rocking chutes 5 and the rocking chute 6. The chips, thus, are well mixed when they leave the lower rocking chute 6 and drop through the outlet 9.

Stones and other heavy particles having dropped down onto the plate 14 are advanced toward the outlet opening 9 due to the vibration movement of the plate 14, which movement describes the same path as the housing 1. When the heavier particles arrive at that portion of the plate which is located closest to the outlet opening 9, they drop down onto a strongly inclined portion 19 of the housing 1 and slide out through an outlet 13.

Prior to leaving the plate 14, stones and other heavy particles pass an air stream 18 originating from a nozzle 11.

The air stream 18 takes along chip particles, which may have followed along, for example between heavier particles, down onto the plate 14. The chip particles found between the heavy particles are taken along by the air stream 18 and describe a parabolic path, whereafter they come down at 12. Said chip particles then are moved toward the outlet opening 9 by the vibrations of the housing 1.

Located in the upper forward portion of the housing 1, above the outlet opening 9, is a suction tap or opening 20 which is connected through a suction conduit 22 to the suction intake of a fan 21. The ejection nozzles 17*a*, 17*b*, and 17*c*, respectively, and 11 are connected to the pressure side of the fan 21 by a fan conduit 23. The air in the air streams 7*a*, 7*b*, and 7*c*, respectively, and 18 is directed through the housing 1 above and beneath the lower rocking chute 6 to the suction opening 20. From there it is passed back to the nozzles 17*a*, 17*b*, 17*c*, respectively, and 11 through the fan 21. The air stream between the nozzles 17*a*, 17*b*, and 17*c*, respectively, and the suction opening 20 passing over the rocking chute 6 is slightly turbulent and thereby contributes to the mixing of possible chip fractions, which may have formed during the air transport of the chips from the rocking chutes 5*a*, 5*b*, and 5*c*, respectively, to the lower rocking chute 6.

In the embodiment described with reference to FIG. 1, the separator has three rocking chutes 5*a*, 5*b*, 5*c*. The number of rocking chutes, however, can be increased or reduced to one, in which case also the number of ejection nozzles is increased or reduced correspondingly.

According to the embodiment described above, the separator is able to effect the separation of heavy fractions, for example from chips, while maintaining the mixture of the different size fractions of the chips.

Following is a description of a second preferred embodiment of the invention which is particularly advantageous for separating heavy fractions, for example, from so-called biomass. The term biomass is to be understood to refer to forest waste material, such as parts of branches, stumps etc. In this application of the invention the material to be classified varies considerably in size and weight.

Figure 3:
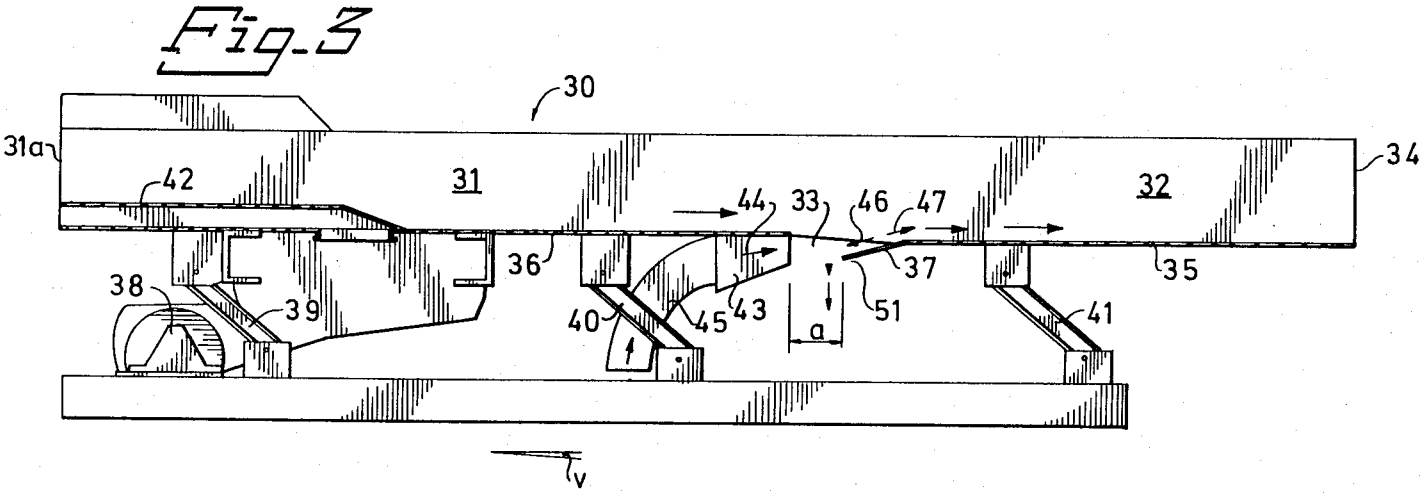
FIG. 3 is a longitudinal section of an air stream separator according to a second embodiment of the invention.

In FIG. 3 an apparatus, designated generally by 30, is shown which is intended to separate sand, stones etc. from biomass or other materials. The apparatus comprises a vibrating conveyor, which is divided into two sections or rocking chutes 31 and 32, respectively. The first section 31 is identical with the first conveyor 5*a*, 5*b*, 5*c*, mentioned above, and the second section 32 is identical with the additional conveyor 6 referred to above. The first section 31 extends from an input end 31*a* to an output end where a gap 33 is located for air separation. The second section 32 extends from said gap 33 to the output end 34 of the section 32. The bottom 35 of the second section 32 is in parallel with the bottom 36 of the first section. The bottom 35 of the second section 32 is located on a lower level than the bottom 36 of the first section; for example, the difference in level can be 50 mm at a width a of the gap 33 of 100 mm. The second section 32 is provided at its input end 51 with an inclined portion in the form of an inclined plane 37, the length of which can be of the same magnitude as the width of the gap 33. In FIG. 3 only a schematic lateral view of the apparatus is shown. The rocking chute 31 and 32, respectively, however, has a substantial width, i.e. a width of about 1 m when the rocking chute has a length of, for example, about 5 m. The gap 33 extends like the inclined plane 37 substantially over the entire width of the rocking chute.

Drive machinary of known type, including a driven eccentric mechanism 38 and suspension struts 39, 40, and 41, respectively, supports and drives the rocking chutes 31 and 32, respectively, in a movement as stated above. The aforementioned drive machinery is of known type and is not described here in detail.

In order to separate sand from the biomass in an initial phase, the biomass is fed down into the rocking chute 31 at its input end 31*a* onto a screen plate 42.

Connected to the gap 33 is an air nozzle 43, which directs an air stream forwardly upward, as indicated by the arrow 44, to pass over the inclined plane 37. The air nozzle 43 is connected to a fan (not shown) via a pipe 45.

The apparatus described with reference to FIG. 3 operates as follows.

Biomass is fed over the screen plate 42 whereby sand drops down through the screen and further down beneath the rocking chute 31. The biomass thereafter is advanced, by movement of the rocking chute, in the direction of the gap 33, whereby heavy fractions, such as stones, collect at the bottom of the rocking chute. In the gap 33 a strong upward air stream prevails. The inclined plane 37 has an angle of inclination to the horizontal plane such that material lying thereon is conveyed rearwardly by the rocking movements as shown by the arrow 46. The strong air stream blows away lighter fractions with great force in the conveying direction to said second section 32. Stones and the like are conveyed rearwardly on the inclined plane 37 in spite of the air stream. The air stream, however, is adjusted so that branches, stump parts and the like, are upwardly conveyed on the inclined plane 37, in the direction of the arrow 47. The intensity of the air stream and/or the angle of the inclined plane to the horizontal plane are adjusted in view of the material to be processed and the fractions to be separated.

Figure 5:
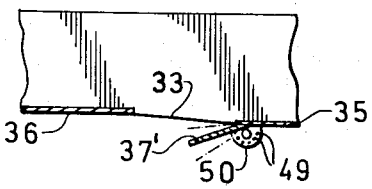
FIGS. 4 and 5 show modified portions of the separator shown in FIG. 3 illustrating two additional embodiments thereof, respectively.

According to a preferred embodiment, therefore, the inclined plane 37 is mounted rotatably at its transition to the bottom 35 of said second section 32 and can be locked in different angular positions relative to the bottom 35 of the second section 32 by conventional adjusting means, for example, a cotter cooperating with one of several holes 49 in a stationary disc 50 as illustrated in FIG. 5. In certain cases it also may be advantageous to be able to vary the width of the gap 33.

According to another embodiment of the entire apparatus 30 is positioned so that the bottoms 36 and 35, respectively, of the rocking chute 31 and 32, respectively, forms an angle v with the horizontal plane of about two to ten degrees, preferably about seven degrees. By such arrangement a suitable compacting of the material and a suitable fraction division of the material during its transport in the rocking chute are obtained. The angle v of course, depends on the material to be processed.

Figure 4:
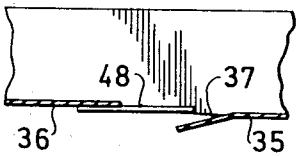

In the processing of biomass, it is desirable to prevent branch and stump parts with relatively short length from dropping through the gap 33 when they are carried over the gap which is transverse to the conveying direction. For this reason, according to an additional preferred embodiment, a number of carrying strips 48 are located suitably spaced relative to each other over the gap 33, as illustrated in FIG. 4. The carrying strips 48 preferably are positioned at such spaced relationship which corresponds to or exceeds the width a of the gap 33.

In the processing of biomass, the carrying strips 48 preferably are designed with such height, that their upper edge projects substantially above the bottom 36 of the rocking chute 31. Hereby the carrying strips guide the material so that the main longitudinal axis of the material parts will coincide with the conveying direction.

Figure 6:
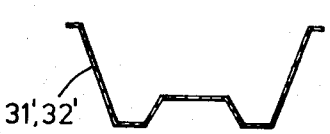
FIG. 6 is a cross-section of a rocking chute according to one embodiment.

The rocking chutes 31' and 32', respectively, according to a preferred embodiment can be fabricated with a profiled cross-section, for example as shown in FIG. 6. Such a design yields a greater contact surface between material and rocking chute, whereby the conveying capacity is increased.

Figure 7:
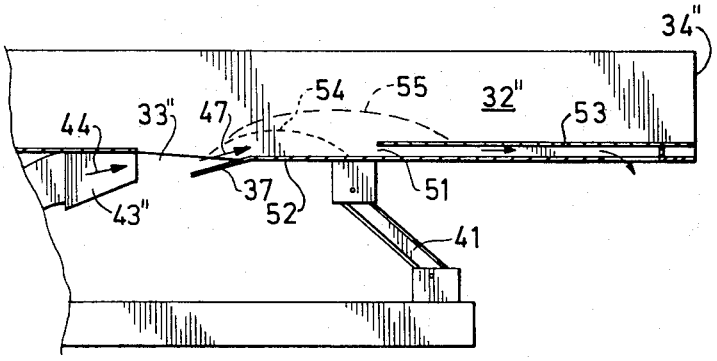
FIG. 7 shows a portion of a longitudinal section, corresponding to the one shown in FIG. 1, according to still another embodiment.

According to an additional embodiment, the second section 32'' is provided with a vertical gap 51, defined as a difference in level of two bottom parts 52 and 53, respectively, of said second section as shown in FIG. 7. The gap 51 is preferably extended across the whole width of the second section. This embodiment is especially effective when fine sand fractions tend to follow the air stream from the nozzle 43'' forward according to the arrow 47. Such sand fractions have a different, shorter, ballistic path 54 from the path 55 of fine chip fractions. The gap 51 is located at such a distance from the gap 33'', that the sand fractions will land before the vertical gap 51 and the chip fractions after the vertical gap 51. The vertical height of the gap 51 may be from 2 mm to 10 mm, preferably 5 mm for separation of fine sand fractions. To separate even very fine fractions of sand is very important for the case where chips are a raw-material for making different kinds of building elements such as boards.

The invention has been described in cases where heavy fractions are to be separated from light product fractions. However, the invention may be used for separating light fractions from a product consisting of a heavier fraction.

The illustrated embodiments of the invention, of course, can be varied in many ways without departing from the scope of the invention. According to the embodiment shown in FIG. 3 the first section 31 and the second section 32 of the rocking chute can be separated from each other and can be provided with a common or separate drivers. Furthermore, the first section of the rocking chute may consist of several rocking chutes arranged one above the other. The rocking chutes 31 and 32, respectively, can also be suitably modified.

In the embodiment according to FIG. 1, the rocking chutes 5*a*, 5*b*, and 5*c*, respectively, can be designed separate from each other, and the rocking chute 6 can be positioned on a higher level. The fan system, furthermore, need not be designed as a closed system.

The invention is not to be regarded as restricted to the embodiments specifically described. but can be varied within the scope of the attached claims.

I claim:

1. An air stream separator for separating a heavier fraction, such as stone, from a mixture including lighter materials having different properties, such as chips, comprising:

A. a first elongate vibrating conveyor means vibrating through planes parallel to the longitudinal direction thereof to convey material forwardly and downstream in said direction, said first conveyor means having an output end;

B. means for generating an air stream comprising an air nozzle located at the output end of said first conveyor means, said nozzle positioned and arranged to direct said air stream upward and forward with respect to said conveying direction;

C. a second elongate vibrating conveyor means positioned downstream of said first conveyor means, said second conveyor means having an input end in spaced relation to the output end of the first conveyor means to define a gap therebetween, said input end being defined by an upwardly inclined portion of said second conveyor means leading into a generally horizontal portion of said second conveyor means, wherein said inclined portion is located to receive said heavier fraction of said material dropping from said output end of said first conveyor means in order to rearwardly convey said heavier fraction in descent along said inclined portion and separated from said lighter particles impelled by said air stream onto said second conveyor means for forward conveyance thereon, said second conveyor means being of a length whereby the air stream impelled particles are received on an intermediate portion thereof, said second conveyor means including an output end remote from the input end, said second conveyor means comprising means for conveying said received particles to the output end of the second conveyor means and mixing said received particles during conveyance thereof;

D. means for vibrating said first and second conveyor means.

2. The air stream separator as claimed in claim 1, wherein the means for vibrating said first and second conveyor means include means for vibrating said second conveyor means in phase with the vibration of said first conveyor means.

3. The air stream separator as claimed in claim 2, further including a plurality of carrying strips aligned in said conveying direction and positioned over said gap.

4. The air stream separator as claimed in claim 1, wherein said means for vibrating said first and second conveyor means includes means for driving said second conveyor means independently from said first conveyor means.

5. The air stream separator as claimed in claim 2 or 4, wherein said inclined portion comprises an inclined plane rotatably mounted in relation to said horizontal portion of said second conveyor means, to enable variable angular position therebetween.

6. The air stream separator as claimed in claim 5, further including a plurality of carrying strips aligned in said conveying direction and positioned over said gap.

7. The air stream separator as claimed in claim 1, 2 or 4, wherein said first conveyor means includes a plurality of conveyor chutes located one above the other, said means for generating an air stream comprising an air nozzle located at the respective output end of each of said plurality of conveyor chutes, said second conveyor means being located on a lower level than the lowermost one of said plurality of conveyor chutes and being in direct particle receiving relationship to each of said conveyor chutes for common discharge of the conveyor chutes onto said second conveyor means, and further including material input means for simultaneously loading said plurality of conveyor chutes.

8. The air stream separator as claimed in claim 1, 2 or 4, wherein said first and second conveyor means are closed within a housing, a suction tap connected to said housing at a position located obliquely above said inclined portion, and a suction conduit, said suction conduit being connected between said suction tap and said air stream generating means to create a suction in said housing.

9. An air stream separator for separating a heavier fraction, such as stone, from a mixture including lighter materials having different properties, such as chips, comprising:

A. a first vibrating conveyor means vibrating through planes parallel to the longitudinal direction thereof to convey material forwardly and downstream in said direction, said first conveyor means having an output end;

B. means for generating an air stream comprising an air nozzle located at the output end of said first conveyor means, said nozzle positioned and arranged to direct said air stream upward and forward with respect to said conveying direction;

C. a second vibrating conveyor means positioned downstream of said first conveyor means, said second conveyor means having an input end in spaced relation to the output end of the first conveyor means to define a gap therebetween, said input end being defined by an upwardly inclined portion of said second conveyor means leading into a generally horizontal portion of said second conveyor means, wherein said inclined portion is located to receive said heavier fraction of said material dropping from said output end of said first conveyor means in order to rearwardly convey said heavier fraction in descent along said inclined portion and separated from said lighter particles impelled by said air stream onto said second conveyor means for forward conveyance thereon, said second conveyor means comprising a first horizontal bottom portion and a second horizontal bottom portion vertically spaced above said first horizontal bottom portion, said first bottom portion being closer to said nozzle than said second bottom portion; and D. means for vibrating said first and second conveyor means.

10. The air stream separator as claimed in claim 9, wherein the means for vibrating said first and second conveyor means include means for vibrating said second conveyor means in phase with the vibration of said first conveyor means.

11. The air stream separator as claimed in claim 9, wherein said means for vibrating said first and second conveyor means includes means for driving said second conveyor means independently from said first conveyor means.

12. An air stream separator for separating a heavier fraction, such as stone, from a mixture including lighter materials having different properties, such as chips, comprising:

A. a first vibrating conveyor means vibrating through planes parallel to the longitudinal direction thereof to convey material forwardly and downstream in said direction, said first conveyor means having an output end;

B. means for generating an air stream comprising an air nozzle located at the output end of said first conveyor means, said nozzle positioned and arranged to direct said air stream upward and forward with respect to said conveying direction;

C. a second vibrating conveyor means positioned downstream of said first conveyor means, said second conveyor means having an input end in spaced relation to the output end of the first conveyor means to define a gap therebetween, said input end being defined by an upwardly inclined portion of said second conveyor means leading into a generally horizontal portion of said second conveyor means, wherein said inclined portion is located to receive said heavier fraction of said material dropping from said output end of said first conveyor means in order to rearwardly convey said heavier fraction in descent along said inclined portion and separated from said lighter particles impelled by said air stream onto said second conveyor means for forward conveyance thereon, said second conveyor means comprising a first horizontal bottom portion and a second horizontal bottom portion vertically spaced above said first horizontal bottom portion, said first bottom portion being closer to said nozzle than said second bottom portion, said inclined portion comprising an inclined plane rotatably mounted in relation to said first horizontal bottom portion of said second conveyor means, to enable variable angular position therebetween; and D. means for vibrating said first and second conveyor means, said means for vibrating said first and second conveyor means including means for vibrating said second conveyor means in phase with the vibration of said first conveyor means.

13. An air stream separator for separating a heavier fraction, such as stone, from a mixture including lighter materials having different properties, such as chips, comprising:

A. a first vibrating conveyor means vibrating through planes parallel to the longitudinal direction thereof to convey material forwardly and downstream in said direction, said first conveyor means having an output end;

B. means for generating an air stream comprising an air nozzle located at the output end of said first conveyor means, said nozzle positioned and arranged to direct said air stream upward and forward with respect to said conveying direction;

C. a second vibrating conveyor means positioned downstream of said first conveyor means, said second conveyor means having an input end in spaced relation to the output end of the first conveyor means to define a gap therebetween said input end being defined by an upwardly inclined portion of said second conveyor means leading into a generally horizontal portion of said second conveyor means, wherein said inclined portion is located to receive said heavier fraction of said material dropping from said output end of said first conveyor means in order to rearwardly convey said heavier fraction in descent along said inclined portion and separated from said lighter particles impelled by said air stream onto said second conveyor means for forward conveyance thereon, said second conveyor means comprising a first horizontal bottom portion and a second horizontal bottom portion vertically spaced above said first horizontal bottom portion, said first bottom portion being closer to said nozzle than said second bottom portion, said inclined portion comprising an inclined plane rotatably mounted in relation to said first horizontal bottom portion of said second conveyor means, to enable variable angular position therebetween; and D. means for vibrating said first and second conveyor means, said means for vibrating said first and second conveyor means including means for driving said second conveyor means independently from said first conveyor means.

* * * * *